US012617013B2

(12) United States Patent
Tokusada et al.

(10) Patent No.: US 12,617,013 B2
(45) Date of Patent: May 5, 2026

(54) SILVER POWDER AND METHOD OF PRODUCING SAME

(71) Applicant: DOWA Electronics Materials Co., Ltd., Tokyo (JP)

(72) Inventors: Kaori Tokusada, Honjo (JP); Hikaru Hayashida, Honjo (JP)

(73) Assignee: DOWA Electronics Materials Co., Ltd., Tokyo (JP)

( * ) Notice: Subject to any disclaimer, the term of this patent is extended or adjusted under 35 U.S.C. 154(b) by 373 days.

(21) Appl. No.: 18/546,779

(22) PCT Filed: Mar. 2, 2022

(86) PCT No.: PCT/JP2022/008924

§ 371 (c)(1),
(2) Date: Aug. 17, 2023

(87) PCT Pub. No.: WO2022/191001

PCT Pub. Date: Sep. 15, 2022

(65) Prior Publication Data

US 2024/0131580 A1 Apr. 25, 2024
US 2024/0227002 A9 Jul. 11, 2024

(30) Foreign Application Priority Data

Mar. 10, 2021 (JP) ..... 2021-038713
Feb. 25, 2022 (JP) ..... 2022-028634

(51) Int. Cl.
*B22F 1/05* (2022.01)
*B22F 1/105* (2022.01)
(Continued)

(52) U.S. Cl.
CPC ..... *B22F 1/05* (2022.01); *B22F 1/105* (2022.01); *B22F 9/04* (2013.01); *B22F 9/24* (2013.01);
(Continued)

(58) Field of Classification Search
None
See application file for complete search history.

(56) References Cited

U.S. PATENT DOCUMENTS 4,396,420 A * 8/1983 Schmidberger ..... B22F 9/08 75/355
2009/0107707 A1 4/2009 Yamakawa et al.

FOREIGN PATENT DOCUMENTS

JP 2005226094 A 8/2005
JP 2007186798 A 7/2007
(Continued)

OTHER PUBLICATIONS

Dec. 10, 2024, the Extended European Search Report issued by the European Patent Office in the corresponding European Patent Application No. 22766960.3.
(Continued)

*Primary Examiner* — Jenny R Wu
(74) *Attorney, Agent, or Firm* — KENJA IP LAW PC

(57) ABSTRACT

Provided are a silver powder having powder physical properties enabling reduction of volume resistivity after firing and a method of producing this silver powder. The silver powder has a tap density of 4.8 g/mL or more, a TAP/D50 value (value determined by dividing the tap density (g/mL) by the volume-based median diameter (μm)) of not less than 7 and not more than 15, and a specific surface area of not less than 0.75 $m^2/g$ and not more than 1.3 $m^2/g$.

1 Claim, 1 Drawing Sheet

(51) Int. Cl.
*B22F 9/04* (2006.01)
*B22F 9/24* (2006.01)

(52) U.S. Cl.
CPC ... *B22F 2009/044* (2013.01); *B22F 2301/255* (2013.01); *B22F 2304/058* (2013.01); *B22F 2998/10* (2013.01); *B22F 2999/00* (2013.01)

(56) References Cited

FOREIGN PATENT DOCUMENTS

| | | | | |
|---|---|---|---|---|
| JP | 2011252140 | A | | 12/2011 |
| JP | 2012216533 | A | | 11/2012 |
| JP | 2012251208 | A | * | 12/2012 |
| JP | 2014221938 | A | | 11/2014 |
| JP | 2015155576 | A | | 8/2015 |
| JP | 2017101268 | A | | 6/2017 |
| JP | 2017206727 | A | | 11/2017 |
| JP | 2018066048 | A | | 4/2018 |
| JP | 2021004410 | A | | 1/2021 |
| KR | 1020200082067 | A | | 7/2020 |
| TW | 200631701 | A | | 9/2006 |
| TW | 201303894 | A1 | | 1/2013 |
| WO | 2012173245 | A1 | | 12/2012 |
| WO | 2017110255 | A1 | | 6/2017 |
| WO | 2021220552 | A1 | | 11/2021 |

OTHER PUBLICATIONS

Dec. 12, 2024, Ruling on the Patent Opposition issued by the Japan Patent Office in the corresponding Japanese Patent No. 7438305.

www.fritsch-international.com, Retrieved on Jan. 30, 2025, from URL: https://www.fritsch-international.com/uploads/tx_messprotokoll/S120019_Rutil-eng-LDB.pdf.

Sep. 12, 2023, International Preliminary Report on Patentability issued in the International Patent Application No. PCT/JP2022/008924.

Sep. 26, 2023, Notification of Reasons for Refusal issued by the Japan Patent Office in the corresponding Japanese Patent Application No. 2022-162672.

Jun. 28, 2025, Office Action issued by the China National Intellectual Property Administration in the corresponding Chinese Patent Application No. 202280020217.1.

Apr. 26, 2022, Notification of Reasons for Refusal issued by the Japan Patent Office in the corresponding Japanese Patent Application No. 2022-028634.

Jul. 12, 2022, Decision of Refusal issued by the Japan Patent Office in the corresponding Japanese Patent Application No. 2022-028634.

May 10, 2022, International Search Report issued in the International Patent Application No. PCT/JP2022/008924.

Sep. 28, 2022, Office Action issued by the Taiwan Intellectual Property Office in the corresponding Taiwanese Patent Application No. 111108459.

Oct. 22, 2025, Office Action issued by the Korean Intellectual Property Office in the corresponding Korean Patent Application No. 10-2023-7028221.

Jan. 30, 2026, Office Action issued by the China National Intellectual Property Administration in the corresponding Chinese Patent Application No. 202280020217.1.

* cited by examiner

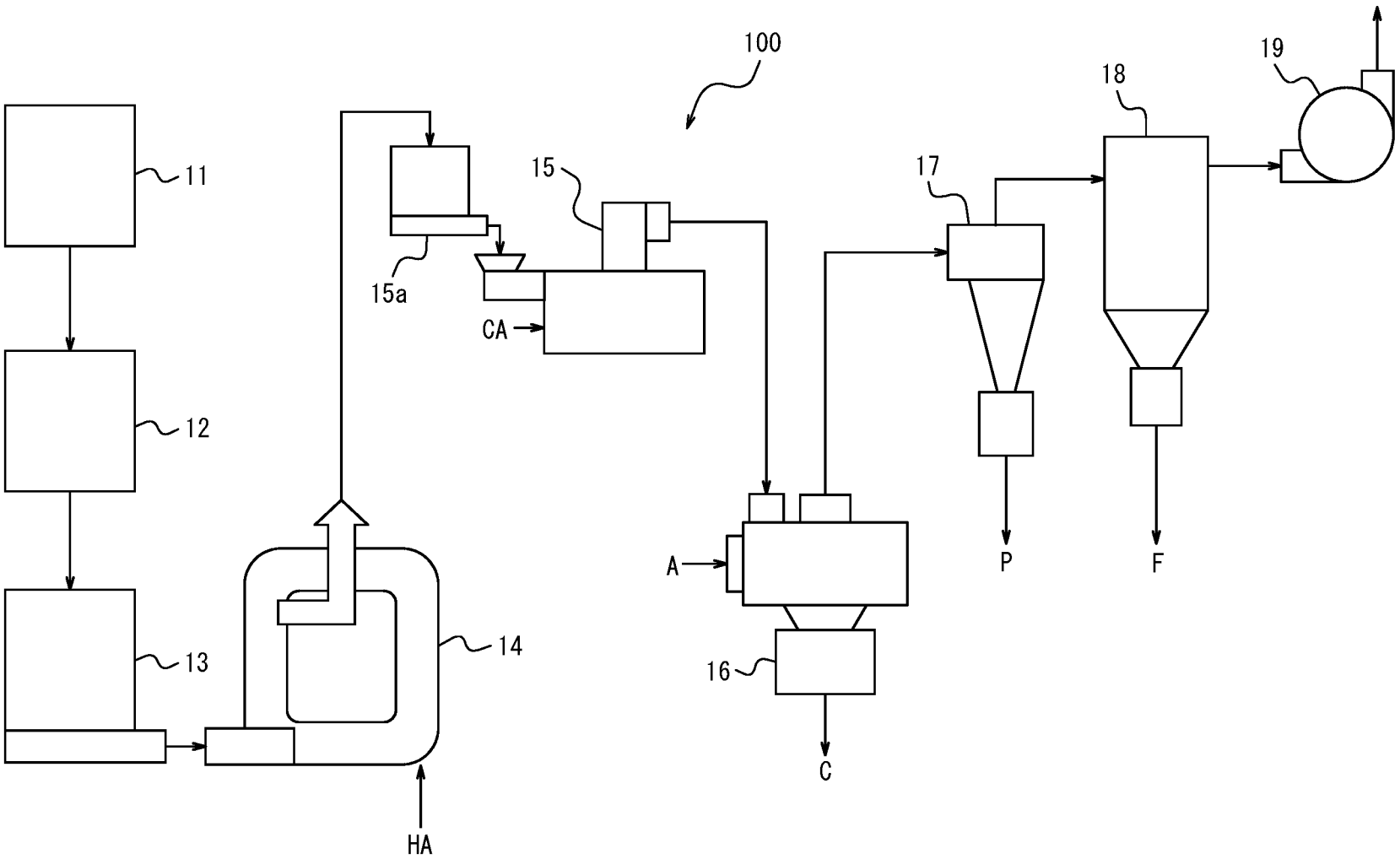
100
11
12
13
14
HA
15
15a
CA
16
A
C
17
P
18
F
19

SILVER POWDER AND METHOD OF PRODUCING SAME

TECHNICAL FIELD

The present disclosure relates to a silver powder and a method of producing the same.

BACKGROUND

Silver pastes are used as conductive pastes in the formation of electrodes and wiring patterns of substrates in electronic components, for example. A silver paste serving as a conductive paste is produced by kneading silver powder with a vehicle and so forth. It is desirable for the silver powder of a conductive paste to have a suitably small particle diameter and a sharp particle size distribution in order to comply with miniaturization of electronic components, formation of conductor patterns with higher density and finer lines, and so on.

Patent Literature (PTL) 1 identifies a problem that with a silver powder produced by a conventional technique, there are instances in which the condition of a coating film or line properties are poor, resulting in the inability to obtain a good fired film and to comply with increased density and finer line formation in a pattern. PTL 1 describes a silver powder and method of producing the same for solving this problem. In the method of producing a silver powder that is described in PTL 1, a silver powder produced by a wet reduction method is subjected to a surface smoothing process in which particles are caused to mechanically collide with one another, and then large agglomerates of silver are removed by classification. PTL 1 reports that a paste in which a silver powder produced by this production method is used enables improvement of line properties, for example.

CITATION LIST

Patent Literature

PTL 1: JP2007-186798A

SUMMARY

Technical Problem

In a conventional technique such as described above, reduction of the particle diameter (volume-based median diameter) of silver particles in a silver powder in production of the silver powder by a wet reduction method tends to be accompanied by an increase of specific surface area of the silver powder and a decrease of tap density of the silver powder. This makes it difficult to fill in voids after a conductive film is formed with a conductive paste in which this silver powder is used and is then fired, and leaves room for improvement of electrical conductivity such as by reducing volume resistivity.

The present disclosure is made in light of the circumstances set forth above, and an object thereof is to provide a silver powder having powder physical properties that enable reduction of volume resistivity after firing and a method of producing this silver powder.

Solution to Problem

A silver powder according to the present disclosure for achieving the object set forth above has:

a tap density of 4.8 g/mL or more;

a TAP/D50 value that is a value determined by dividing the tap density, in units of g/mL, by volume-based median diameter, in units of μm, of not less than 7 and not more than 15; and a specific surface area of not less than 0.75 $m^2/g$ and not more than 1.3 $m^2/g$.

A method of producing a silver powder according to the present disclosure for achieving the object set forth above comprises:

a milling step of using high-pressure airflow to accelerate and mill a silver powder produced by a wet reduction method; and a classification step of classifying the silver powder, performed after the milling step, wherein the milling step is performed with the silver powder having a concentration of 0.2 $kg/m^3$ or less, and the classifying is performed such that after the classification step, the silver powder has powder physical properties of:

a tap density of 4.8 g/mL or more;

a TAP/D50 value that is a value determined by dividing the tap density by volume-based median diameter, in units of μm, of not less than 7 and not more than 15; and a specific surface area of not less than 0.75 $m^2/g$ and not more than 1.3 $m^2/g$.

Advantageous Effect

Provided are a silver powder having powder physical properties that enable reduction of volume resistivity after firing and a method of producing this silver powder.

BRIEF DESCRIPTION OF THE DRAWINGS

In the accompanying drawings:

FIG. 1 illustrates one example of a plant for producing silver powder.

DETAILED DESCRIPTION

A silver powder according to a present embodiment is a powder that is a collection of fine silver particles. The following describes the silver powder according to the present embodiment and a method of producing this silver powder.

(Silver Powder)

The silver powder according to the present embodiment has a tap density of 4.8 g/mL or more. Moreover, when a value determined by dividing the tap density of the silver powder by the volume-based median diameter (μm) of fine silver particles in the silver powder is defined as a TAP/D50 value, this TAP/D50 value is not less than 7 and not more than 15. Furthermore, the silver powder has a specific surface area of not less than 0.75 $m^2/g$ and not more than 1.3 $m^2/g$. As a result of the silver powder having powder physical properties such as set forth above, it is possible to achieve reduction of volume resistivity of a conductive film that is obtained by forming a conductive paste using the silver powder, drawing a conductive film pattern such as a conductor pattern or an electrode through application, printing, or the like of this conductive paste, and then firing the conductive film pattern.

The silver powder according to the present embodiment is realized through a production method that includes a milling step of using high-pressure airflow to accelerate and mill a silver powder produced by a wet reduction method and a classification step of classifying the silver powder, performed after the milling step.

In the production method of the silver powder according to the present embodiment, the milling step is performed with the silver powder having a concentration of 0.2 kg/m$^3$ or less. The classifying is performed such that after the classification step, the silver powder has powder physical properties of a tap density of 4.8 g/mL or more, a TAP/D50 value (value determined by dividing the tap density by the volume-based median diameter (μm)) of not less than 7 and not more than 15, and a specific surface area of not less than 0.75 m$^2$/g and not more than 1.3 m$^2$/g.

Note that the specific surface area of the silver powder according to the present embodiment is more preferably 0.8 m$^2$/g or more, and even more preferably 0.9 m$^2$/g or more. A specific surface area of more than 1.3 m$^2$/g may result in excessively high paste viscosity and poor printability. Although it is normally difficult to obtain a silver powder that has a high tap density while also maintaining a comparatively large specific surface area, the present disclosure enables the achievement of both a high tap density and a specific surface area that is within the range set forth above.

Conventionally, a case in which the median diameter is small and the specific surface area is large has meant that the tap density is small and the TAP/D50 value is less than 7. Even in a case in which the median diameter is large and the specific surface area is small, the TAP/D50 value has been less than 7 because the tap density does not significantly increase.

In order to increase the tap density of a silver powder, it is necessary to improve packability of the silver powder. A powder having good packability generally has a suitably large particle diameter (for example, median diameter) and a suitably wide particle size distribution for fine particles in the powder and has a spherical particle shape. As the particle diameter of fine particles in a powder decreases or as the particle shape becomes distorted, the surface area of the particles increases, adhesive force becomes relatively large relative to the mass of the particles, cohesiveness of the powder increases, and fluidity of the powder decreases. This makes it easier for gaps to form between particles during packing of the powder, reduces packability, and lowers tap density. As set forth above, powder physical properties such as fluidity and packability (tap density, etc.) and particle physical properties such as specific surface area and particle diameter (median diameter, etc.) are correlated characteristics. Accordingly, it is thought that characteristics of a silver powder can be understood by measuring tap density, specific surface area, and median diameter and by evaluating a relationship between these physical properties. For example, in the case of a powder having a large tap density and a small median diameter (i.e., a large TAP/D50 value), this powder can be evaluated as a powder having small particle diameter but low cohesiveness and good packability.

Therefore, it is expected that by producing a silver powder with control to a suitable specific surface area such as described above and so as to satisfy a high tap density and TAP/D50 value, it is possible to provide a silver powder having suppressed cohesiveness and good dispersibility, thereby enabling achievement of reduction of volume resistivity.

In the following description, a conductive film that is obtained by a silver powder undergoing conductive paste formation, application or printing, and then firing is referred to simply as a conductive film. Moreover, the volume resistivity of a conductive film after firing is referred to simply as the volume resistivity.

With regards to powder physical properties of the silver powder, it is more preferable that the TAP/D50 value is not less than 7 and not more than 10. A TAP/D50 value that is within this range leads to further reduction of volume resistivity.

Moreover, with regards to powder physical properties of the silver powder, it is preferable that the median diameter is not less than 0.32 μm and not more than 1 μm, and more preferable that the median diameter is not less than 0.4 μm and not more than 0.8 μm. A median diameter that is within any of these ranges leads to further reduction of volume resistivity. In particular, volume resistivity further decreases when the median diameter is 0.8 μm or less.

The tap density of the silver powder is the apparent density of the silver powder in a vessel having a specific capacity after a specific amount of the silver powder is measured out and loaded into the vessel, and then an operation of dropping the vessel from a specific height is performed a specific number of times (hereinafter, referred to as "after tapping"). The tap density of the silver powder is calculated by dividing the weight of the silver powder in the vessel by the apparent volume of the silver powder in the vessel.

In the present embodiment, the tap density of the silver powder can be taken to be a value that is determined by measuring out 30 g of the silver powder, loading the powder into a vessel (20 mL test tube), and performing tapping 1,000 times with a height of 20 mm using a tap density measurement device (Density Measuring System SS-DA-2 produced by Shibayama Scientific Co., Ltd.), and then dividing the weight of the silver powder (i.e., 30 g) by the apparent volume (mL) of the silver powder after tapping.

The volume-based median diameter of the silver powder can be a value that is determined based on a particle size distribution for the silver powder measured by a commercially available wet laser diffraction particle size analyzer.

In the present embodiment, values measured using a laser diffraction/scattering particle size analyzer (MICROTRAC MT3300EXII produced by MicrotracBEL Corp.) can be adopted as the particle size distribution and the median diameter of the silver powder. Note that when referring simply to particle size distribution in the following description, this means the volume-based particle size distribution. Moreover, when referring simply to median diameter, this means the median diameter based on the volume-based particle size distribution.

The following procedure and conditions can be adopted as the operating procedure and conditions during measurement. First, 0.1 g of the silver powder is added to 40 mL of a polyvinylpyrrolidone (PVP) solution (solvent: isopropyl alcohol) of 1 weight % in concentration. Next, a tip of an ultrasonic homogenizer (MODEL US-150T produced by NISSEI Corporation) having a tip diameter of 20 mm is loaded into the PVP solution to which the silver powder has been added, and 2 minutes of ultrasonic dispersion is performed to prepare a dispersion of silver particles. Next, the dispersion is loaded into the aforementioned laser diffraction/scattering particle size analyzer, a particle size distribution of silver particles in this dispersion is measured, and the median diameter is determined based on the particle size distribution.

Note that the median diameter is the diameter at which the cumulative amount of particles from a small particle diameter end of the particle size distribution reaches 50%. The median diameter is also sometimes referred to as the 50% particle diameter, D50, or the like. In the following description, the median diameter is also referred to as the D50. In addition, the diameter at which the cumulative amount of particles from the small diameter end of the particle size distribution reaches 10% is also referred to as the D10, and likewise, the diameter at which this cumulative amount reaches 90% is also referred to as the D90.

The specific surface area of the silver powder is a value that is determined by the BET method. In the present embodiment, a value that is measured using a specific surface area analyzer (Macsorb HM-model 1210 produced by Mountech Co., Ltd.) adopting the BET method can be used. The measurement conditions can be set as loading 3 g of the silver powder into a measurement cell, passing a carrier gas obtained by mixing 70 volume % of He gas and 30 volume % of nitrogen gas through the measurement cell and performing 10 minutes of deaeration at 60° C., and then performing measurement by the single-point BET method.

The silver powder is preferably a collection of spherical fine silver particles (hereinafter, referred to as a spherical silver powder). The term "spherical" used in relation to a fine silver particle means that the fine silver particle has an aspect ratio of less than 2. The term "spherical silver powder" refers to a silver powder containing fine silver particles that have an average aspect ratio of less than 2.

(Production Method of Silver Powder)

The following describes a production method that is suitable for producing the silver powder according to the present embodiment. Note that the method of producing a silver powder described below is one example of implementation of production of the silver powder according to the present embodiment and that the silver powder according to the present embodiment is not limited to a powder produced by the production method described below.

The method of producing the silver powder according to the present embodiment includes a milling step of using high-pressure airflow to accelerate and mill a silver powder produced by a wet reduction method, a classification step of classifying the silver powder, performed after the milling step, and a pneumatic conveyance step of pneumatically conveying the silver powder that has been classified.

The milling step is performed with the silver powder having a concentration of 0.20 kg/m$^3$ or less. In the following description, the concentration of the silver powder in the milling step is also referred to as the powder concentration during milling.

In the pneumatic conveyance step, conveying is performed with the silver powder having a concentration of 0.080 kg/m$^3$ or less. Moreover, a silver powder that is recovered in the pneumatic conveyance step has powder physical properties (examples of physical properties of a powder of fine silver particles) of a tap density of 4.8 g/mL or more, a TAP/D50 value (value determined by dividing the tap density by the volume-based median diameter (μm)) of not less than 7 and not more than 15, and a specific surface area of not less than 0.75 m$^2$/g and not more than 1.3 m$^2$/g. In the following description, the concentration of the silver powder in the pneumatic conveyance is also referred to as the powder concentration during pneumatic conveyance.

The following describes a method of producing a silver powder by a wet reduction method. The wet reduction method is a method in which an alkali or complexing agent is added to a silver salt-containing aqueous solution to produce a silver oxide-containing slurry or a silver complex salt-containing aqueous solution, and then a reductant is added to cause reduction precipitation of silver powder.

The wet reduction method can include processing of adding a dispersant to the silver slurry resulting from reduction precipitation or processing of adding a dispersant to an aqueous reaction system containing at least one of a silver salt and silver oxide prior to causing reduction precipitation of silver powder with the aim of preventing secondary agglomeration, obtaining monodisperse particles, and thereby improving characteristics of an electronic component in which a conductive paste is used. One or more selected from fatty acids, fatty acid salts, surfactants, organometallics, and protective colloids can be used as the dispersant.

In one example, production of a silver powder by the wet reduction method is performed in a vessel such as a reaction tank. The silver powder straight after production by the wet reduction method may be in the form of a slurry, for example. The silver powder is, therefore, subjected to filtration, water washing, dehydration, and subsequent drying to a powdered form before undergoing the milling step.

FIG. 1 illustrates one example of a flow diagram of a plant 100 for implementing a method of producing a silver powder that is described below. Silver powder is pneumatically conveyed in this plant 100.

The following outlines the plant 100. The plant 100 according to the present embodiment includes at least a reaction tank 11 that synthesizes silver powder, a milling device 15, a classifying device 16, and a collecting device. The plant 100 has the milling device 15, the classifying device 16, and the collecting device (a cyclone 17 and a dust collector 18 in one example) connected in series in this order downstream of the reaction tank 11. In the plant 100, pneumatic conveyance in which silver powder supplied to the milling device 15 is pneumatically conveyed to the collecting device is configured as a continuous process. Pneumatic conveyance in the plant 100 is performed through suction by an exhaust ventilator 19 that is connected at a downstream side of the collecting device. Silver powder that is produced in the reaction tank 11 is processed by the milling device 15, the classifying device 16, and the cyclone 17 so as to control the tap density, TAP/D50 value, and specific surface area of a silver powder P that is recovered. In the plant 100, reduction of volume resistivity is achieved through this control.

The concentration of silver powder in the milling step referred to in the following description (i.e., the powder concentration during milling) is defined as a value determined by dividing the supply rate (kg/min) at which silver powder is supplied to the milling device 15 by the supply airflow rate (m$^3$/min) at which air is supplied to the milling device 15. Lowering the powder concentration during milling causes collision/milling operation to proceed smoothly without stagnation or blocking of silver powder inside of the milling device 15 and improves milling efficiency of coarse particles. This can also inhibit the occurrence of short pathing. Consequently, it is possible to reduce the amount of coarse particles (agglomerated powder) that proceed to the next step without disintegration. The powder concentration during milling is 0.20 kg/m$^3$ or less as previously described. This makes it possible to implement production of a silver powder having a tap density of 4.8 g/mL or more, a TAP/D50 value (value determined by dividing the tap density by the volume-based median diameter (μm)) of not less than 7 and not more than 15, and a specific surface area of not less than 0.75 m$^2$/g and not more than 1.3 m$^2$/g. This facilitates filling in of voids between silver particles after a conductive film is formed with a conductive paste in which the silver powder is used and is then fired, and makes it possible to achieve reduction of volume resistivity of the conductive film.

In the plant 100 that has the milling device 15, the classifying device 16, and the collecting device connected in series in this order and where pneumatic conveyance in which silver powder that has been supplied to the milling device 15 is pneumatically conveyed to the collecting device is performed continuously, the powder concentration from the classifying device 16 onwards is even lower than the low powder concentration during milling described above because, in addition to air supplied into the milling device 15, air is also supplied into the classifying device 16. As a result, the occurrence of short pathing is inhibited (i.e., the amount of powder proceeding to the next step without being classified is reduced and separation of just coarse powder is facilitated), and classification performance improves. Note that improvement of classification performance means having a sharper partial classification efficiency curve, for example.

In the collecting device, centrifugal force acts on particles such that the particles are pressed against a wall side while swirling around and gravitational acceleration also acts on the particles such that the particles drop and are collected. Note that adopting a powder concentration that is even lower than the powder concentration during milling as described above enables a higher cyclone inlet velocity. This makes it possible to increase centrifugal force in the cyclone 17 and improve recovery efficiency.

The concentration of silver powder in pneumatic conveyance that is referred to in the following description (i.e., the powder concentration during pneumatic conveyance) is defined as a value determined by dividing the supply rate (kg/min) at which silver powder is supplied to the milling device 15 by the exhaust airflow rate ($m^3$/min) of the exhaust ventilator 19. This powder concentration during pneumatic conveyance can be thought of as the powder concentration in the classifying device 16 and the collecting device. By setting the powder concentration during milling as 0.20 kg/$m^3$ or less and setting the powder concentration during pneumatic conveyance as 0.080 kg/$m^3$ or less in the plant 100, it is possible to implement production of a silver powder having a tap density of 4.8 g/mL or more, a TAP/D50 value (value determined by dividing the tap density by the volume-based median diameter (μm)) of not less than 7 and not more than 15, and a specific surface area of not less than 0.75 $m^2$/g and not more than 1.3 $m^2$/g. This facilitates filling in of voids between silver particles after a conductive film is formed with a conductive paste in which the silver powder is used and is then fired, and makes it possible to achieve reduction of volume resistivity of the conductive film. In the following description, the exhaust airflow rate of the exhaust ventilator 19 is also referred to simply as the airflow rate. Moreover, the concentration of silver powder in pneumatic conveyance is also referred to simply as the powder concentration during pneumatic conveyance.

In other words, in the plant 100 in which pneumatic conveyance is performed continuously, inhibition of stagnation and blocking of silver powder inside of a device is achieved by setting the powder concentration during milling in the milling device 15 as 0.20 kg/$m^3$ or less and setting the powder concentration during pneumatic conveyance as 0.080 kg/$m^3$ or less. Moreover, setting the powder concentration during milling as 0.20 kg/$m^3$ or less causes collision/milling operation to smoothly proceed, improves milling efficiency of coarse particles, inhibits the occurrence of short pathing, and makes it possible to achieve reduction of the amount of coarse particles (agglomerated powder) that proceed to the next step.

Furthermore, setting the powder concentration during pneumatic conveyance as 0.080 kg/$m^3$ or less inhibits the occurrence of short pathing in the classifying device 16, causes discharge of coarse particles, in particular, in a high ratio, and improves classification efficiency. It is easier to set the powder concentration in the classifying device 16 to the concentration set forth above as a result of the powder concentration during milling being set as 0.20 kg/$m^3$ or less.

Moreover, as a result of setting the powder concentration during pneumatic conveyance as 0.080 kg/$m^3$ or less, it is possible to increase the inlet velocity of the cyclone. This makes it possible to clarify the particle diameter boundary between ultrafine powder that is to be cut and the silver powder P that is to be recovered in the cyclone 17 and thus to achieve improvement of recovery efficiency. The following provides a detailed description of each part of the plant 100.

The plant 100 illustrated in FIG. 1 presents a case in which silver powder produced by a wet reduction method in the reaction tank 11 is then subjected to filtration, water washing, and dehydration through a filtration device 12 such as a filter press, for example, and in which drying after dehydration is performed in a dryer 14 or the like. Note that typical filtration devices and dryers may be used as the filtration device 12 and the dryer 14. After filtration in the filtration device 12 and prior to supply into the dryer 14, the dry cake present after filtration may be temporarily stored in a cushion tank 13 or the like that is equipped with a feeder. Silver powder that has been dried in the dryer 14 is supplied to the subsequently described milling device 15. The silver powder is milled by the milling device 15, is subsequently classified by the classifying device 16, and is then collected by the cyclone 17. The milling device 15, the classifying device 16, and the cyclone 17 are connected in series, and the silver powder is transported from the milling device 15 to the cyclone 17 by continuous pneumatic conveyance. In other words, pneumatic conveyance in the plant 100 is configured as a continuous process. This pneumatic conveyance is performed through suction by the exhaust ventilator 19, which is a fan, a blower, or the like. Note that the dust collector 18 is arranged between the cyclone 17 and the exhaust ventilator 19 such that ultrafine powder F that has passed through the cyclone 17 is removed.

Silver powder that has been dried in the dryer 14 may be collected by a cyclone (not illustrated) or the like and may then be temporarily stored by a cushion tank (not illustrated) or the like prior to being supplied to the milling device 15. Moreover, the silver powder may be supplied from the cushion tank to the milling device 15 at a specific supply rate through a powder metering feeder 15*a* or the like.

Note that FIG. 1 illustrates a case in which the dryer 14 is a dryer in which silver powder resides (for 0.7 seconds in one example) while being circulated in circulating airflow and in which the silver powder is disintegrated and dried while heating airflow HA (for example, 110° C.) or disintegrating high-pressure airflow (compressed air in one example) is supplied to the circulating silver powder so as to sort and discharge a disintegrated and dried silver powder through a built-in pneumatic classifying mechanism. One examples of such a dryer 14 is a FLASH JET DRYER (produced by Seishin Enterprise Co., Ltd.). The dryer 14 is not limited to being a device in which circulating airflow is used and may be a so-called shelf dryer, conical dryer, fluidized bed dryer, horizontal paddle dryer, or the like.

The following describes the milling step. The milling step is a step in which silver particles of a silver powder are accelerated and milled by compressed air. Note that when describing acceleration and milling of silver particles of a silver powder by compressed air, this may be referred to simply as a milling operation. Note that the term "milling" as used in the present embodiment does not refer to an operation of breaking up primary particles, but instead refers to the milling (loosening or disintegration) of secondary particles to cause dispersion as primary particles.

As one example, the milling operation can be performed using a milling device 15 such as a pneumatic mill (referred to as a "jet mill"). The milling is performed through collisions of silver particles with one another, collisions between silver particles and an inner wall surface or impact plate of the mill, and shear force of the compressed air.

Examples of specific pneumatic mills that can implement the milling operation include a jet mill, a super jet mill (produced by Nisshin Engineering Inc.), and a spiral jet mill (produced by Hosokawa Micron Corporation) that implement the milling operation in swirling high-pressure airflow, and an opposed jet mill (produced by Hosokawa Micron Corporation) and a cross jet mill (produced by Kurimoto, Ltd.) that implement the milling operation by supplying high-speed air airflows into a fluidized bed of fluidized fine silver particles from a plurality of supply holes such that the high-speed airflows collide.

The milling device is preferably a mill having a built-in classifier or classifying mechanism for inhibiting coarse powder discharge (hereinafter, referred to simply as a mill with built-in classifier). By using a mill with built-in classifier as the milling device, it is possible to suppress the occurrence of a failure in terms of fine silver particles that have been supplied into the milling device in an agglomerated state being discharged from the milling device without resolution of the agglomerated state. Moreover, by adjusting the classification conditions of the classifier or classifying mechanism and freely adjusting the residence time of the silver powder inside of the milling device, it is possible to control the milling state (for example, the particle size distribution).

The aforementioned super jet mill is one example of a mill with built-in classifier that has a built-in classifying mechanism for performing centrifugal classification through swirling flow generated by milling airflow. Moreover, the opposed jet mill and the cross jet mill are each one example of a mill with built-in classifier that has a classifying rotor for performing centrifugal classification built in as a classifier.

In the milling device 15, compressed air CA having a pressure of approximately 0.6 MPa is supplied as one example of high-pressure airflow. The energy of this compressed air CA causes milling of the silver powder to proceed.

The supply rate of the powder metering feeder 15*a* can be used as the supply rate at which silver powder is supplied into the milling device 15. In the following description, the supply rate at which silver powder is supplied into the milling device 15 (supply rate of the powder metering feeder 15*a*) is also referred to simply as the supply rate during milling operation. The powder concentration during milling can be determined by dividing the supply rate during milling operation by the supply airflow rate ($m^3$/min) of the compressed air CA. In other words, in a case in which the milling device 15 is a pneumatic mill, a value determined by dividing the supply rate during milling operation by the supply airflow rate of the compressed air CA should be 0.20 kg/$m^3$ or less.

The classification step is a step in which a classification operation is performed to remove (cut) excessively large particles (coarse powder) and excessively small particles (fine powder) from the silver powder present after the milling step. The classification step is performed after the milling step. The classification operation is preferably performed in airflow.

The classification step can be performed using a mechanical classifier including a classifying rotor or the like that implements centrifugal classification, a classifier that implements centrifugal classification through a swirling flow (free vortex or semi-free vortex) generated through supply of high-speed airflow, a classifier that utilizes inertial force of particles accelerated by a bending high-speed airflow and the Coanda effect, or the like. Moreover, a cyclone may be used in a case in which fine powder is to be cut. Note that in the classification step, cutting of coarse powder and cutting of fine powder may be performed by one device or one step, or cutting of coarse powder and cutting of fine powder may be performed by two devices or two or more steps.

FIG. 1 illustrates a case in which a classifying device 16 for coarse powder cutting is connected at a downstream side of the milling device 15. Silver powder discharged from the milling device 15 is supplied in that form to the classifying device 16. Secondary air A may be taken into the classifying device 16 as necessary.

Examples of machinery and devices that can implement coarse powder cutting include a Turbo Classifier (produced by Nisshin Engineering Inc.), which is a forced vortex-type classifier, an Aerofine Classifier (produced by Nisshin Engineering Inc.), which implements centrifugal classification through a free vortex or semi-free vortex generated through supply of high-speed airflow, and an Elbow-Jet (produced by Matsubo Corporation), which utilizes inertial force of particles accelerated by bending high-speed airflow and the Coanda effect. In addition, a cyclone can be used to perform fine powder cutting.

The silver powder present after coarse powder cutting may be collected in a cyclone, for example. In the following description, a step of collecting silver powder after coarse powder cutting to obtain a silver powder P for paste formation is also referred to as a collection step. In FIG. 1, the silver powder after coarse powder cutting that has been discharged from the classifying device 16 (silver powder at fine powder side) is pneumatically conveyed in that form to the cyclone 17. Coarse powder C that has been cut by the classifying device 16 is discharged externally of the classifying device 16 and is processed separately. In the present embodiment, fine powder cutting is performed during collection in the cyclone 17, and ultrafine powder F is removed with exhaust air from the exhaust side of the cyclone 17 and is processed separately. The silver powder P for paste formation that is collected in the cyclone 17 is discharged from the coarse powder side of the cyclone 17 and is recovered. The silver powder P that is obtained in this manner has good powder physical properties of a tap density of 4.8 g/mL or more, a TAP/D50 value of not less than 7 and not more than 15, and a specific surface area of not less than 0.75 $m^2$/g and not more than 1.3 $m^2$/g. Note that collection in the cyclone 17 is preferably performed in a state in which the powder concentration during pneumatic conveyance is 0.080 kg/m$^3$ or less as previously described. The supply rate at which silver powder is supplied from the classifying device 16 is roughly equal to the supply rate of the powder metering feeder 15*a*.

The following describes examples.

Example 1

83 kg of a silver nitrate solution containing 1.2 kg of silver was prepared. Next, 3.8 kg of ammonia aqueous solution having a concentration of 25.8 mass % was added to this silver nitrate solution so as to prepare an aqueous reaction system containing silver ions. The liquid temperature of this aqueous reaction system was set to 25° C.

Next, 0.3 kg of 80 mass % hydrazine aqueous solution as a reductant was added to the aqueous reaction system and was thoroughly stirred therewith to yield a slurry containing silver particles.

Next, 0.09 kg of 5 mass % oleic acid as a dispersant was added to this slurry and was thoroughly stirred therewith.

The slurry obtained after maturation was subjected to filtration, water washing, and dehydration, and was then further disintegrated and dried (for example, using a FLASH JET DRYER as a dryer 14).

The dried silver powder was subsequently subjected to continuous pneumatic conveyance through a milling device, a classifying device, and a cyclone that were connected in series while undergoing milling as a milling step, classification as a classification step, and collection as a collection step as described below. Specifically, in the present example, suction was performed with respect to the milling device, the classifying device, and the cyclone through one exhaust ventilator, and the powder concentration during pneumatic conveyance in the classifying device and the cyclone was a value determined by dividing the supply rate at which fine silver particles were supplied to the milling device (supply rate during milling operation) by the exhaust airflow rate (airflow rate) of the exhaust ventilator. Moreover, the powder concentration during milling was a value determined by dividing the supply rate during milling operation by the supply airflow rate at which air was supplied into the mill (hereinafter, also referred to as the mill supply airflow rate).

After drying of the silver powder, a milling device (Jet Mill CJ-25 produced by Nisshin Engineering Inc. serving as a milling device 15) was first used to mill the silver powder (one example of a milling step). The powder concentration during milling was set as 0.11 kg/m$^3$.

The silver powder present after the milling step was subjected to a classification process (one example of a classification step) by the classifying device that was connected in series at a downstream side of the milling device, and was then captured by the cyclone connected in series at a downstream side of the classifying device so as to obtain a silver powder having an adjusted particle size distribution. The powder concentration during pneumatic conveyance was set as 0.033 kg/m$^3$.

The silver powder obtained through the classification step was used to produce a conductive paste (silver paste) as described below. A conductive paste was obtained by mixing 85 mass % of the silver powder obtained through the classification step, 7.4 mass % of a vehicle (mixture of terpineol, texanol, butyl carbitol acetate, and ethyl cellulose) as an organic binder, 1.2 mass % of a wax (castor oil), 0.5 mass % of 100 cs dimethylpolysiloxane, 0.25 mass % of triethanolamine, 0.25 mass % of oleic acid, 2.0 mass % of Pb—Te—Bi-based glass frit, and 3.4 mass % of a solvent (mixture of terpineol and texanol) through stirring at 1,400 rpm for 30 seconds using a propeller-less planetary stirring and defoaming device (AR250 produced by Thinky Corporation) and then passing and kneading the mixture through a three-roll mill (80S produced by Exakt Technologies Inc.) with a roll gap of 100 μm to 20 μm.

This conductive paste was used to form a conductor pattern. Formation of the conductor pattern was performed as described below. First, an aluminum paste (RX8252D2 produced by Rutech) was used to form a 154 mm-square solid pattern on the rear surface of a silicon substrate (100 Ω/sq.) for a solar cell. Formation of this solid pattern was performed using a screen printer (MT-320TV produced by Micro-tec Co., Ltd.). Thereafter, 10 minutes of hot-air drying was performed at 200° C. Next, the conductive paste was filtered through 500 μm mesh, and then four busbar electrodes of 0.7 mm in width were printed (drawn) by plate design with a squeegee speed of 350 mm/s at a front surface-side of the substrate.

After performing 10 minutes of hot-air drying at 200° C., a high-speed firing IR furnace (high-speed firing test four-chamber furnace produced by NGK Insulators, Ltd.) was used to perform firing with a peak temperature of 770° C. and an in-out time of 41 seconds to obtain a conductive film having a busbar electrode shape as a conductor pattern.

The electrical conductivity of the conductive film was evaluated. The electrical conductivity was evaluated by the volume resistivity. Evaluation of volume resistivity was performed as follows. Specifically, the line resistance of the conductive film was measured using a digital multimeter (7451A produced by Advantest Corporation), the thickness of the conductive film was measured using a surface roughness meter (SURFCOM 1500D produced by Tokyo Seimitsu Co., Ltd.), the length of the conductive film was measured using a ruler, and the line resistance (Ω) was multiplied by the film thickness (μm) and the line width (mm) and then further by ×100 to determine the volume resistivity (μΩ·cm).

Table 1 presents processing conditions of the silver powder according to Example 1, and, more specifically, presents the supply rate of silver powder, the mill supply airflow rate, the mill concentration, the pneumatic conveyance airflow rate, and the pneumatic conveyance powder concentration. In addition, Table 1 presents physical properties of the silver powder present after the classification step and evaluation results, and, more specifically, presents powder physical properties of the silver powder used for paste formation and volume resistivity as electrical conductivity of the conductive film. Note that "Supply rate" in the columns for processing conditions of the silver powder in Table 1 means the supply rate during milling operation.

TABLE 1

| | Silver powder processing conditions | | | | | Powder physical properties of silver powder used in paste formation | | | | | | | Electrical con- |
|---|---|---|---|---|---|---|---|---|---|---|---|---|---|
| | Supply rate kg/min | Mill supply airflow rate $m^3$/min | Powder concen- tration during milling kg/ $m^3$ | Pneumatic convey- ance airflow rate $m^3$/ min | Powder concen- tration during pneumatic conveyance kg/$m^3$ | Specific surface area $m^2$/g | D10 μm | D50 μm | D90 μm | D90/ D10 | Tap den- sity g/mL | TAP/ D50 value g/mL · μm | ductivity Volume re- sistivity μΩ · cm |
| Example 1 | 0.33 | 3.0 | 0.11 | 10.1 | 0.033 | 1.03 | 0.200 | 0.560 | 1.000 | 5.00 | 5.5 | 9.82 | 2.4 |
| Example 2 | 0.65 | 3.7 | 0.18 | 11.6 | 0.056 | 1.11 | 0.273 | 0.701 | 1.279 | 4.68 | 5.0 | 7.13 | 2.3 |
| Example 3 | 0.65 | 3.7 | 0.18 | 10.1 | 0.064 | 1.12 | 0.234 | 0.642 | 1.208 | 5.16 | 4.8 | 7.48 | 2.4 |
| Example 4 | 0.33 | 3.2 | 0.10 | 10.1 | 0.033 | 1.15 | 0.236 | 0.683 | 1.210 | 5.13 | 4.8 | 7.03 | 2.4 |
| Example 5 | 0.33 | 3.3 | 0.10 | 11.6 | 0.028 | 0.80 | 0.316 | 0.696 | 1.366 | 4.32 | 5.4 | 7.76 | 2.6 |
| Comparative Example 1 | 0.33 | 1.0 | 0.33 | 1.5 | 0.220 | Not processable due to stagnation in device | | | | | | | — |
| Comparative Example 2 | 1.30 | 3.5 | 0.37 | 10.1 | 0.129 | Not processable due to stagnation at inlet | | | | | | | — |
| Comparative Example 3 | 0.65 | 2.5 | 0.26 | 7.5 | 0.087 | 1.00 | 0.36 | 0.80 | 1.55 | 4.31 | 5.0 | 6.25 | 2.8 |

Example 2

Example 2 differs from the production method in Example 1 in terms that the supply rate during milling operation was roughly doubled, thereby slightly less than doubling the powder concentration during milling (0.18 kg/$m^3$) and slightly less than doubling the powder concentration during pneumatic conveyance (0.056 kg/$m^3$). With the exception of these points, production of a milled and classified silver powder, production of a conductive paste using this silver powder, production of a conductive film using this conductive paste, and so on were performed in the same manner, and volume resistivity of the conductive film was evaluated. Processing conditions for the silver powder according to Example 2, physical properties of the silver powder present after the classification step, and evaluation results are shown in Table 1.

Example 3

Example 3 differs from the production method in Example 1 in terms that the supply rate during milling operation was roughly doubled, thereby slightly less than doubling the powder concentration during milling (0.18 kg/$m^3$) and slightly less than doubling the powder concentration during pneumatic conveyance (0.064 kg/$m^3$), and in terms that the classification conditions of the classification step were changed so as to change the particle size distribution (D50, etc.). With the exception of these points, production of a milled and classified silver powder, production of a conductive paste using this silver powder, production of a conductive film using this conductive paste, and so on were performed in the same manner, and volume resistivity of the conductive film was evaluated. Processing conditions for the silver powder according to Example 3, physical properties of the silver powder present after the classification step, and evaluation results are shown in Table 1.

Example 4

In Example 4, 0.04 kg of 10 mass % Selosol as a dispersant was added to the slurry after hydrazine addition instead of the 5 mass % oleic acid used as a dispersant in Example 1 and was thoroughly stirred therewith.

The slurry was subsequently subjected to filtration, water washing, and dehydration, and was then disintegrated in the same way as in Example 1. After disintegration, drying was performed using a conical dryer. The dried silver powder was then subjected to continuous pneumatic conveyance through a milling device, a classifying device, and a cyclone connected in series while undergoing milling, classification, and collection in the same way as in Example 1. Note that in Example 4, the powder concentration during milling was roughly the same (0.10 kg/$m^3$) as in the production method of Example 1 and the powder concentration during pneumatic conveyance was the same as in the production method of Example 1. Processing conditions for the silver powder according to Example 4, physical properties of the silver powder present after the classification step, and evaluation results are shown in Table 1.

Example 5

83 kg of a silver nitrate solution containing 1.2 kg of silver was prepared. Next, 2.4 kg of ammonia aqueous solution of 25.8 mass % in concentration was added to this silver nitrate solution to prepare an aqueous reaction system containing silver ions. In addition, 0.5 kg of sodium carbonate of 5 mass % in concentration and 0.006 kg of polyethyleneimine (average molecular weight: 300) of 5 mass % in concentration were added into the aqueous reaction system. The liquid temperature of the aqueous reaction system was set to 30° C.

Next, 0.4 kg of 70 mass % hydrazine carbonate aqueous solution as a reductant was added and thoroughly stirred to yield a slurry containing silver particles.

Next, 0.1 kg of 5 mass % oleic acid as a dispersant was added to this slurry and was thoroughly stirred therewith.

The slurry was subsequently subjected to filtration, water washing, and dehydration, and was then disintegrated in the same way as in Example 1. After disintegration, drying was performed using a conical dryer. The dried silver powder was then subjected to continuous pneumatic conveyance through a milling device, a classifying device, and a cyclone connected in series while undergoing milling, classification, and collection in the same way as in Example 1. Note that in Example 5, the powder concentration during milling was roughly the same (0.10 kg/$m^3$) as in the production method of Example 1 and the powder concentration during pneumatic conveyance was slightly lower (0.028 kg/$m^3$) than in the production method of Example 1. Processing conditions for the silver powder according to Example 5, physical properties of the silver powder present after the classification step, and evaluation results are shown in Table 1.

Comparative Example 1

In Comparative Example 1, the airflow rate was significantly reduced and the powder concentration during pneumatic conveyance was increased by roughly 6.7 times compared to in the production method of Example 1. However, the milling step could not be continued due to stagnation of silver powder inside the milling device. Processing conditions for the silver powder according to Comparative Example 1, physical properties of the silver powder present after the classification step, and evaluation results are shown in Table 1.

Comparative Example 2

In Comparative Example 2, the supply rate during milling operation was increased by roughly 4 times and the powder concentration during pneumatic conveyance was increased by roughly 4 times compared to the production method in Example 1. However, the milling step could not be continued due to silver powder blocking an inlet part of the milling device. Processing conditions for the silver powder according to Comparative Example 2, physical properties of the silver powder present after the classification step, and evaluation results are shown in Table 1.

Comparative Example 3

Comparative Example 3 differs from the production method of Example 1 in terms that the supply rate during milling operation was roughly doubled and the airflow rate was reduced to slightly more than 70%, thereby increasing the powder concentration during pneumatic conveyance by roughly 2.6 times. With the exception of these points, production of a silver powder for which milling and classification were attempted, production of a conductive paste using this silver powder, production of a conductive film using this conductive paste, and so on were performed in the same manner, and the volume resistivity of the conductive film was evaluated. Processing conditions for the silver powder according to Comparative Example 3, physical properties of the silver powder present after the classification step, and evaluation results are shown in Table 1.

As indicated in Table 1, conductive films obtained using the silver powders according to Examples 1 to 3 display low values of 2.3 μΩ·cm to 2.4 μΩ·cm for volume resistivity and have good electrical conductivity. This good electrical conductivity is thought to be achieved because the silver powders according to Examples 1 to 3 each have a tap density of 4.8 g/mL or more and a TAP/D50 value of not less than 7 and not more than 15 (particularly of not less than 7 g/mL·μm and not more than 10 g/mL·μm), which facilitates filling in of voids between silver particles after a conductive film is formed with a conductive paste in which the silver powder is used and is then fired. This is also thought to be due to these silver powders having a specific surface area of at least 0.75 $m^2/g$ or more, and specifically of not less than 0.9 $m^2/g$ and not more than 1.3 $m^2/g$ (particularly in a range of not less than 1 $m^2/g$ and not more than 1.2 $m^2/g$) and surfaces having undergone suitable milling, classification, and collection. This is also thought to be due to the silver powders each having a median diameter of not less than 0.32 μm and not more than 1 μm (particularly of not less than 0.4 μm and not more than 0.8 μm) and having a suitable particle diameter (particle size).

As indicated in Table 1, a value determined by dividing the D90 value by the D10 value (hereinafter, referred to as the D90/D10 value) for the silver powders of Examples 1 to 4 is 5.00, 4.68, 5.16, and 5.13 for the silver powders of Examples 1 to 4, respectively, and is larger than the value in Example 5 (4.32). Based on the fact that Examples 1 to 4 have lower volume resistivity than Example 5, the particle size distributions of the silver powders having a suitable range for D50 while also having a suitable degree of widening with a D90/D10 value of not less than 4.5 and not more than 5.5 is also thought to contribute to facilitating filling in of voids between silver particles after a conductive film is formed with a conductive paste in which the silver powder is used and is then fired, and to improving electrical conductivity.

Although the paste viscosity of conductive pastes in which these silver powders were used was not evaluated, good line properties were achieved without observation of swelling or chipping during writing of a conductive film pattern. In other words, the conductive films obtained using the silver powders according to Examples 1 to 3 also had good characteristics other than electrical conductivity.

On the other hand, the conductive film of Comparative Example 3 has a volume resistivity of 2.8 μΩ·cm and cannot be said to have particularly good electrical conductivity. This is thought to be because although the silver powder according to Comparative Example 3 has a tap density of 4.8 g/mL or more, the TAP/D50 value thereof falls below 7 g/mL·μm, making it difficult to fill in voids between silver particles after a conductive film is formed with a conductive paste in which the silver powder is used and is then fired.

The D90/D10 value being 4.31 as indicated in Table 1 and thus the particle size distribution not being suitably broad is also thought to have an effect in terms of making it difficult to fill in voids between silver particles after a conductive film is formed with a conductive paste and is then fired, and in terms of being unable to achieve good electrical conductivity.

As viewed from a production method perspective, good milling operation, classification, and collection operation are implemented without the occurrence of stagnation inside the milling device or the occurrence of blocking of the inlet of the milling device with the conditions of steps from milling to the cyclone (silver powder processing conditions) according to Examples 1 to 3. Moreover, production of a silver powder having good electrical conductivity is achieved as previously described. Therefore, setting the powder concentration during pneumatic conveyance as 0.080 $kg/m^3$ or less is judged to be suitable for producing the silver powder according to the present embodiment.

On the other hand, since a milling step could not be suitably performed in Comparative Examples 1 and 2, the production conditions of the silver powders according to Comparative Examples 1 and 2 cannot be said to constitute a production method that is suitable for producing the silver powder according to the present embodiment. Moreover, although the production conditions of the silver powder according to Comparative Example 3 enabled the implementation of a milling step, the electrical conductivity of a conductive film formed using the silver powder obtained thereby did not have the desired characteristic, and thus the production conditions of the silver powder according to Comparative Example 3 cannot be said to constitute a production method that is suitable for producing the silver powder according to the present embodiment. In the case of Comparative Example 3, it is thought that appropriate particle size distribution adjustment could not be performed due to the powder concentration during pneumatic conveyance exceeding 0.080 kg/m$^3$.

As set forth above, it is possible to provide a silver powder having powder physical properties that enable reduction of volume resistivity after firing and a method of producing this silver powder.

Note that configurations disclosed in the above-described embodiments (inclusive of alternative embodiments; same applies below) can be adopted in combination with configurations disclosed in other embodiments so long as they are not in contradiction. Also note that the embodiments disclosed in the present specification are examples and that embodiments of the present disclosure are not limited thereto and can be modified as appropriate to the extent that they do not deviate from the object of the present disclosure.

INDUSTRIAL APPLICABILITY

The present disclosure can be adopted with respect to a silver powder and a method of producing a silver powder.

REFERENCE SIGNS LIST

11 reaction tank
12 filtration device
13 cushion tank
14 dryer
15 milling device
15*a* powder metering feeder
16 classifying device
17 cyclone
18 dust collector
19 exhaust ventilator
100 plant
A secondary air
C coarse powder
CA compressed air
F ultrafine powder
HA heating airflow
P silver powder

The invention claimed is:

1. A method of producing a silver powder comprising:

a milling step of using a pneumatic mill to accelerate and mill a silver powder produced by a wet reduction method; and a classification step of classifying the silver powder, performed after the milling step, wherein the milling step is performed with the silver powder having a powder concentration during milling of 0.2 kg/m$^3$ or less, the classifying is performed such that after the classification step, the silver powder has powder physical properties of:

a tap density of 4.8 g/mL or more;

a TAP/D50 value that is a value determined by dividing the tap density by volume-based median diameter, in units of μm, of not less than 7 and not more than 15; and a specific surface area of not less than 0.75 m$^2$/g and not more than 1.3 m$^2$/g, a milling device in the milling step, a classifying device in the classification step, and a collecting device are connected in series in this order, an exhaust ventilator is connected at a downstream side of the collecting device and performs suction such that silver powder that has been supplied to the milling device is pneumatically conveyed to the collecting device, and a powder concentration during pneumatic conveyance determined by dividing a supply rate of silver powder in the milling step by an airflow rate of the exhaust ventilator is 0.08 kg/m$^3$ or less.

* * * * *